United States Patent [19]

Aylott

[11] 4,140,139

[45] Feb. 20, 1979

[54] MOUNTING AND PACKAGING OF ARTIFICIAL FINGERNAILS

[76] Inventor: Eric V. Aylott, Llanfrechfa Way, Monmouthshire, Wales

[21] Appl. No.: 766,829

[22] Filed: Feb. 8, 1977

[30] Foreign Application Priority Data

Feb. 25, 1976 [GB] United Kingdom ..... 7426/76
Oct. 27, 1976 [GB] United Kingdom ..... 44641/76

[51] Int. Cl.[2] ..... A45D 29/00
[52] U.S. Cl. ..... 132/73; 206/45.14
[58] Field of Search ..... 132/73, 73.5, 75, 88.5, 132/88.7; 206/45.34, 45.14, 823, 56

[56] References Cited

U.S. PATENT DOCUMENTS

| | | | |
|---|---|---|---|
| 2,288,386 | 6/1942 | Belden | 206/823 X |
| 3,136,416 | 6/1964 | Goldrosen | 206/56 |
| 3,199,670 | 8/1965 | Palmer | 206/45.34 |
| 3,485,344 | 12/1969 | Aylott | 206/45.14 |
| 3,698,404 | 10/1972 | Greco | 132/79 R |
| 3,982,551 | 9/1976 | Bartolucci | 132/73 |

*Primary Examiner*—G. E. McNeill
*Attorney, Agent, or Firm*—Blum, Moscovitz, Friedman & Kaplan

[57] ABSTRACT

An artificial fingernail mounting is provided having a frame to which a plurality of artificial fingernails are secured by their tips leaving the cuticle ends of the fingernails free to facilitate the selection of a fingernail by a user. The mounting may be packaged in a parallelpiped box having aligned transparent sections enabling a possible purchaser to examine and select the artificial fingernails without removing the fingernails from the box.

4 Claims, 8 Drawing Figures

MOUNTING AND PACKAGING OF ARTIFICIAL FINGERNAILS

FIELD OF THE INVENTION

This invention relates to an artificial fingernail mounting and a package of artificial fingernails.

BRIEF DISCUSSION OF THE PRIOR ART

At present artificial fingernails are usually presented in a package having ten vacuum-formed insets in which loose artificial fingernails are located. The package has a transparent cover enabling a possible purchaser to examine the artificial fingernails and also retaining the loose artificial fingernails in their own respective insets. A package usually also includes several spare artificial fingernails of different sizes, and adhesive for securing the artificial fingernails to the nature nails of a user and an artificial fingernail remover.

SUMMARY OF THE PRESENT INVENTION

According to the present invention an artificial fingernail mounting comprises a frame to which a plurality of artificial fingernails are secured by their tips leaving the cuticle ends of the artificial fingernail free to facilitate selection thereof.

In one embodiment of the present invention there is provided an improved package which allows a purchaser to examine and select fingernails with respect to size without removing the fingernails from the package.

In accordance with this aspect of the present invention a package of artificial fingernails comprises a frame to which a plurality of artificial fingernails secured by their tips, a box within which the frame and artificial fingernails are removably disposed, and a transparent portion, forming part of the box, through which a plurality of artificial fingernails are visible, the transparent portion of the box being positioned and arranged to enable an interested person to examine and select artificial fingernails with respect to suitability by placing a finger beneath an artificial fingernail and looking through said transparent portion.

According to a second preferred arrangement a package of artificial fingernails comprises two trays which fit together one on top of the other, each tray including a plurality of artificial fingernails removably secured thereto by their tips leaving their cuticle ends free. The trays may either nest one on top of the other or may be hinged together so that one tray folds on top of the other.

Preferably a package of artificial fingernails in accordance with the second embodiment of the invention comprises two trays which fit together one on top of the other, and a plurality of artificial fingernails removably secured to each tray, each artificial fingernail being secured to its respective tray at or adjacent the tip of the fingernail by a weakened portion so that a fingernail may hinge about its weakened portion to allow insertion of a user's natural fingernail beneath an artificial fingernail to facilitate selection of a desired artificial fingernail without removal thereof.

Preferably a package also includes a suitable adhesive and remover, and also instructions on how to use the package.

BRIEF DESCRIPTION OF THE DRAWINGS

The invention will now be described by way of example with reference to the accompanying drawings in which.

DESCRIPTION OF THE PREFERRED EMBODIMENTS

Figure 1:
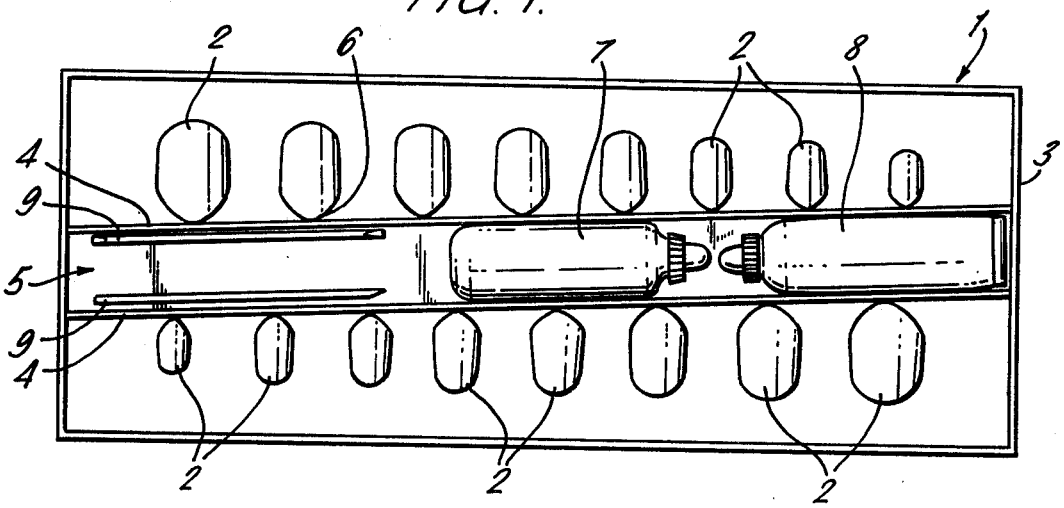
FIG. 1 is a plan of a first preferred embodiment of a frame.

In the drawings an injection moulded frame 1 for artificial fingernails 2 consists of an outer rectangular surround 3 and a pair of intermediate spaced bars 4 defining a compartment 5. The bars 4 are located at an angle between the shorter sides of the surround 3 to accommodate the various sizes of artificial fingernails 2.

The artificial fingernails 2 are secured to the bars 4 by a weakened portion or nib 6 between the tip of a fingernail and an adjacent bar. Preferably there are eight artificial fingernails provided along each bar 4 to allow for variation in size between user's fingernails. The compartment 5 contains a supply of adhesive 7, a supply of remover 8, an emery board (not shown), instructions (not shown) and one or more cuticle tools 9 for facilitating the location of an artificial fingernail under the cuticle of a user.

Figure 2:
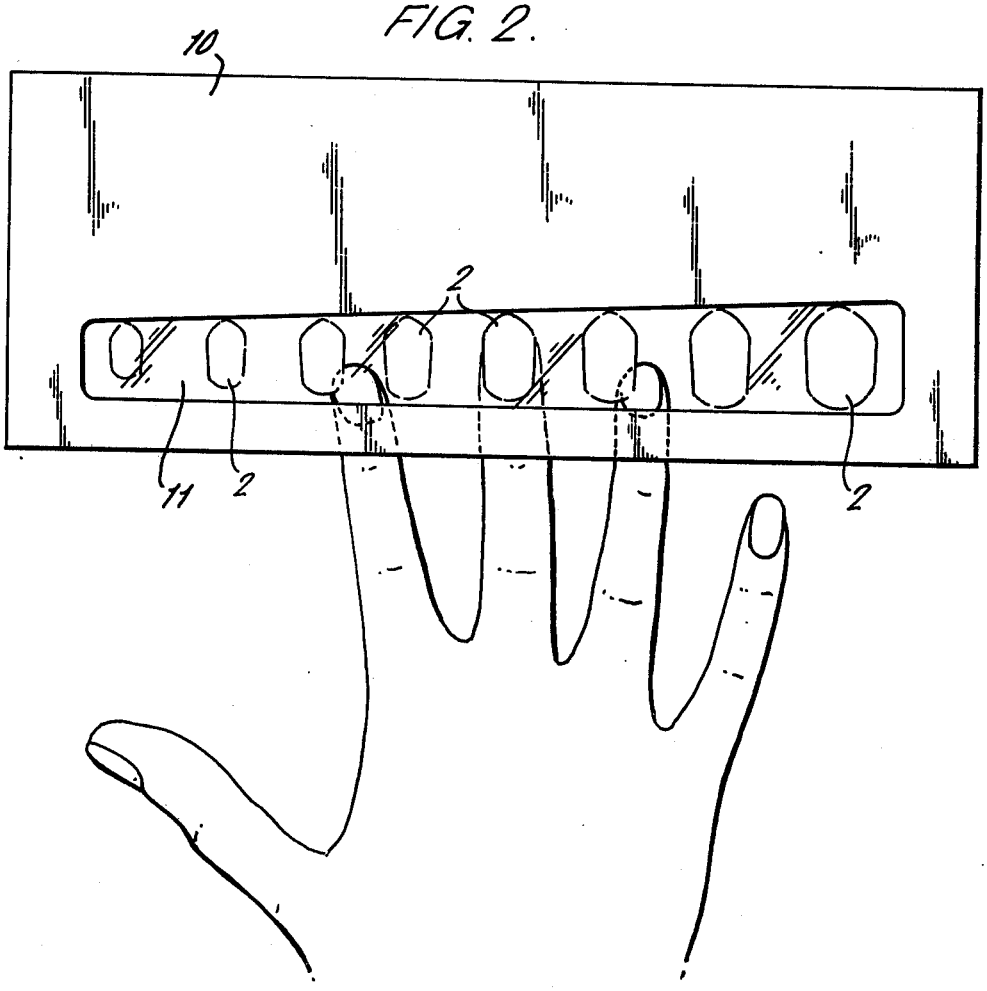
FIG. 2 is a plan view of a box containing such a frame and illustrating selection of an artificial fingernail by a user.

As shown in FIG. 2 the frame 1 is fitted within a rectangular box 10, which has an aligned transparent portion 11 in the top and bottom of the box, positioned so that one half of the sixteen artificial fingernails 2 are visible on inspection. As shown in FIG. 2, in order to examine the suitability of the fingernails 2, all a potential customer need do is pick up the box and place her finger under the aligned transparent portions 11, and therefore gauge the size suitability.

The package of FIGS. 1 and 2 is particularly useful in selling artificial nails to women who may be embarrassed by the condition of their own nails, since it allows the women to test the nails for themselves without the aid of a shop assistant.

Figure 3:
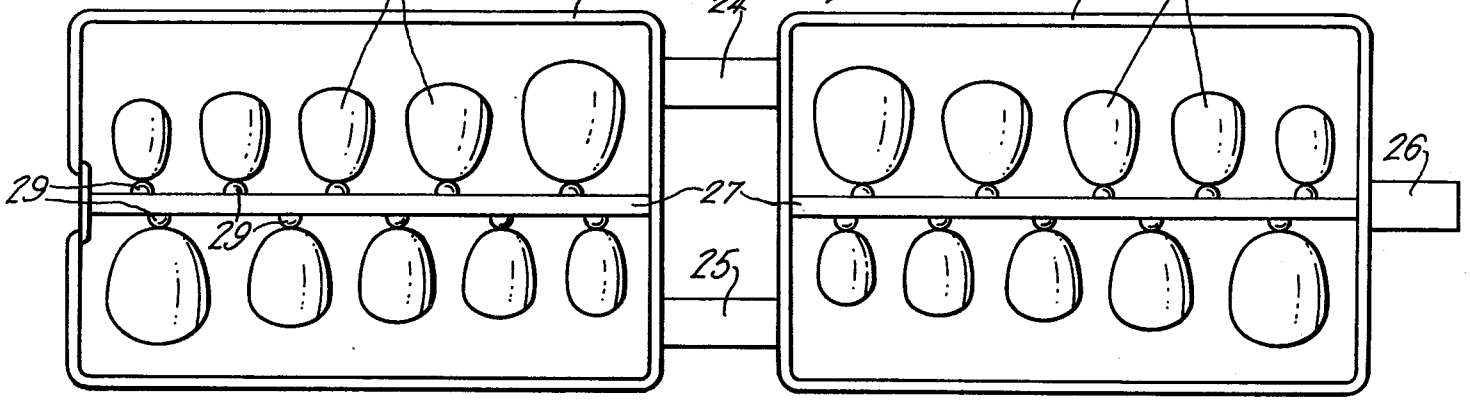
FIG. 3 is a plan view of a second embodiment.
Figure 4A:
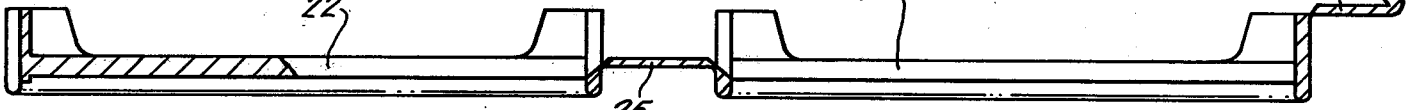
FIG. 4*a* is a side elevation of FIG. 3.
Figure 4:
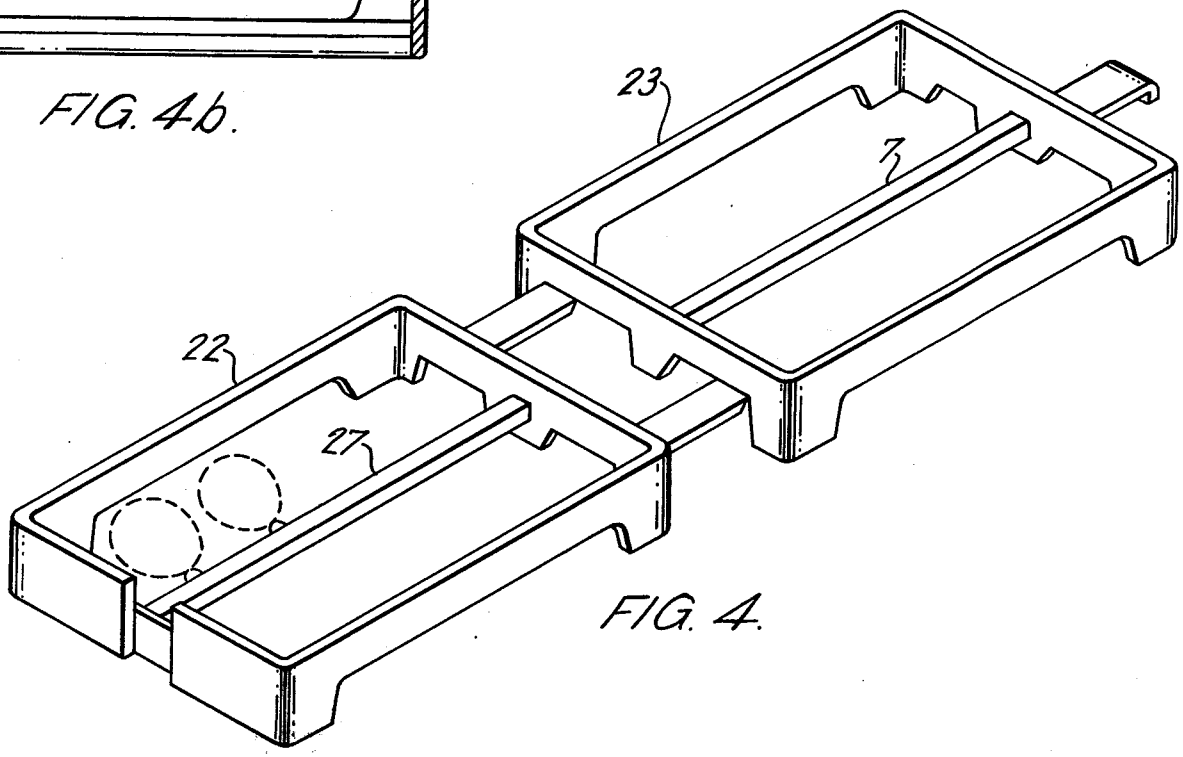
FIG. 4 is an underneath perspective view.
Figure 4B:
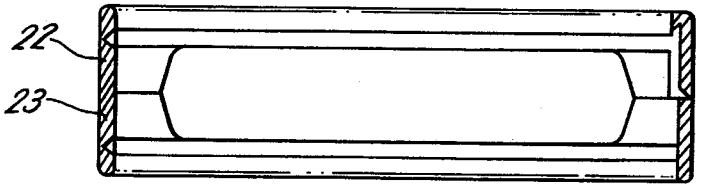
FIG. 4*b* is a side view of the package of FIG. 3 closed.
Figure 5:
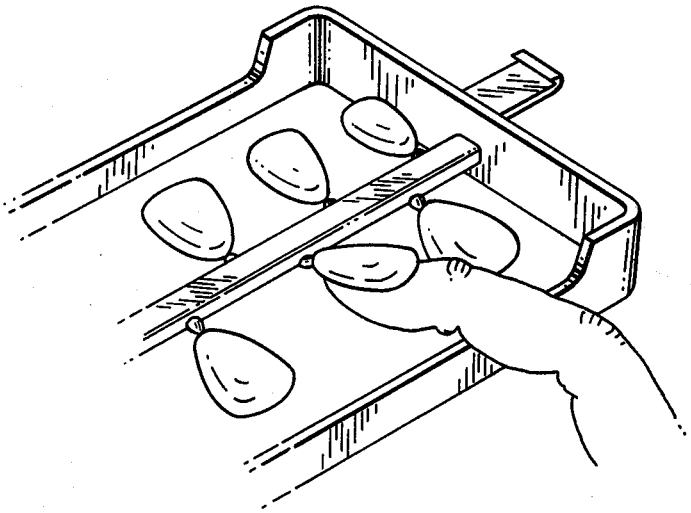
FIG. 5 is a perspective view of the package of FIG. 3 broken away showing fingernail selection.

In the embodiment of FIGS. 3 to 5 an artificial fingernail package 21 has two trays 22 and 23 joined together by two integral hinge members 24 and 25. The provision of hinge members 24 and 25 allows the package 1 to be moulded in plastics material complete as a one piece moulding and allows one tray to fit on top of the other secured together by a latch member 26 — see FIGS. 4*a* and 4*b*.

Each tray 22 and 23 is moulded with a central bar 27 to which a plurality of artificial fingernails 28 are attached. Preferably there are five fingernails 28 provided on each side of a central bar 27 as shown and the fingernails 28 are secured to the central bar 27 by a weakened portion or nib 29 between the tip of a fingernail 28 and the central bar 27.

Figure 6:
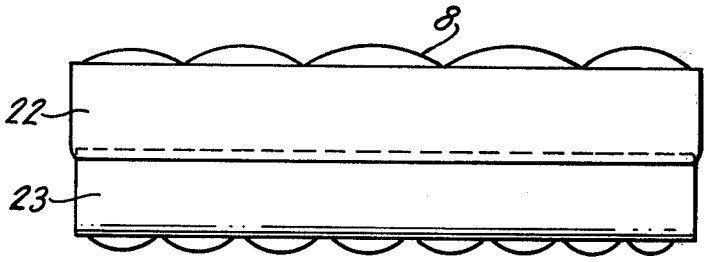
FIG. 6 is a side elevation of a third alternative embodiment.

FIG. 6 illustrates a similar embodiment in which trays 22 and 23 are as shown in FIG. 3. However in the embodiment of FIG. 6 the trays 22 and 23 are not hinged together but fit one on top of the other by nesting.

As with the embodiment of FIGS. 1 and 2 the artificial fingernail package of FIGS. 3 to 6 preferably will include loose, between the trays when closed, a supply of adhesive, a supply of remover, an emery board and a sheet of cardboard to retain the components within the package. Also the package itself may be disposed in an outer box.

In use the frame 1 of FIGS. 1 and 2 or the plastics fingernail package 21 of FIGS. 3 to 6 is removed from the box (not shown in FIGS. 3 to 6): the package 21 is then opened to separate the two trays 22 and 23 into a position as shown in FIG. 3. With either embodiment a user then selects the ten most suitable fingernail sizes by placing the appropriate finger under an artificial finger and comparing whether or not the size is suitable for the finger — see FIGS. 2 and 5. In the embodiments of FIGS. 3 to 6 the provision of weakened portions allow the fingernails to hinge into the positions shown in FIG. 5 without breaking away.

Once ten suitable fingernails have been selected by a user the frame 1 or the trays 22 and 23 are reversed and a thin coating of adhesive applied to the back of the selected fingernails in turn. Whilst the adhesive is setting the user cleans and dries her own natural fingernails thoroughly and loosens the cuticles. A small amount of adhesive is then applied to each natural fingernail, the selected artificial fingernails removed from the frame or trays by breaking the weakened portions and the artificial fingernails pressed firmly into position above the natural fingernails. Finally the tips of the fingernails are filed to give a smooth finish.

The artificial fingernails may be removed from a user's hand by applying supplied remover beneath the tip of the artificial fingernails and loosening. When preparing the artificial fingernails for re-use the selected nails are preferably laid upon an adhesive strip provided upon the aforementioned cardboard sheet. In this position adhesive is reapplied to the fingernails and the fingernails secured as before.

Although the invention has been particularly described and illustrated with reference to the artificial fingernails being secured by weakened portions between the extreme points of the fingernails and the frame, the term "tip" is intended to be construed as a broad term embracing not only the extreme points but also to each side by the extreme points of the artificial fingernails.

What is claimed is:

1. An artificial fingernail mounting assembly comprising, in combination, a plurality of artificial fingernails curved to the contour of a natural fingernail having a tip end, a cuticle end, and a weakend portion disposed at the tip end portion, a frame including a portion centrally disposed with respect to said artificial fingernails, each said artificial fingernail being secured at said tip end through said weakened portion of said frame, each said tip end weakend portion being supported on said centrally disposed portion of said frame so that said cuticle end of each of said fingernails project away from said frame in such a manner as to permit a sufficient clearance for a natural fingernail to be inserted under each of said artificial fingernails and aligned with the artificial fingernail to thereby optimize the selection for removal from the frame of an artificial fingernail of appropriate size and shpae.

2. An artificial fingernail mounting as claimed in claim 1, wherein the frame consists of a rectangular surround and said centrally disposed portion, said centrally disposed portion including a pair of intermediate spaced bars defining a compartment therebetween.

3. An artificial fingernail mounting as claimed in claim 2, wherein the bars are inclined to the sides of the surround to accommodate the various sizes of the artificial fingernails.

4. An artificial fingernail mounting as claimed in claim 1, wherein said weakened portion is positioned at least at the extreme point of each fingernail.

* * * * *